US006314191B1

(12) United States Patent
Smith

(10) Patent No.: US 6,314,191 B1
(45) Date of Patent: Nov. 6, 2001

(54) FIREPLACE ACCESSORY

(76) Inventor: Mignon J. Smith, 1528 W. University Dr., Mesa, AZ (US) 85201

( * ) Notice: Subject to any disclaimer, the term of this patent is extended or adjusted under 35 U.S.C. 154(b) by 0 days.

(21) Appl. No.: 09/621,301

(22) Filed: Jul. 20, 2000

(51) Int. Cl.[7] ..... H04R 25/00
(52) U.S. Cl. ..... 381/160; 381/61; 126/500
(58) Field of Search ..... 381/61, 334, 336, 381/160, 87; 126/500; 40/428; 181/155, 199

(56) References Cited

U.S. PATENT DOCUMENTS 5,594,802 * 1/1997 Berghoff et al. ..... 381/61
5,826,357 * 10/1998 Hechler ..... 40/428

* cited by examiner

*Primary Examiner*—Huyen Le

(57) ABSTRACT

An accessory for gas log fireplaces that includes a crackling sound generating mechanism for simulating the sounds of a log fire and a scent dispensing mechanism for simulating the slight smoke scent of a log fire. The fireplace accessory includes an infrared heat sensor in controlling connection with the sound generating mechanism and the scent dispensing mechanism such that when a fire is burning in the fireplace, the sound and scent generating mechanisms are in operation. The fireplace accessory also includes a parabolic sound reflector that is positioned within the fireplace. In use, the crackling fire sound is generated outside the fireplace and directed toward the parabolic sound reflector. The parabolic sound reflector reflects the crackling fire sound out of the fireplace such that the crackling fire sound appears to originate from within the fireplace.

1 Claim, 5 Drawing Sheets

INFRARED DETECTOR
INFRARED SWITCH ASSEMBLY
MAIN POWER SWITCH
BATTERY OR POWER SUPPLY
44
42
VOLUME CONTROL
40
+VCC
AUDIO AMPLIFIER
SOUND CHIP
36
38
PIEZO SPEAKER
50
18
60
TIMED AIR FRESHENER ASSEMBLY
22
34

FIREPLACE ACCESSORY

TECHNICAL FIELD

The present invention relates to fireplace accessories and more particularly to a fireplace accessory that includes a heat resistant housing having a hollow interior in connection with the exterior thereof through a scent dispensing aperture and a sound emitting aperture, a sound generating mechanism for generating the crackling sound of a burning fire positioned within the heat resistant housing, a scent dispensing mechanism for dispensing a scent similar to the scent of a burning wood fire positioned within the heat resistant housing, and a parabolic sound reflector constructed of a material with sufficient heat resistance to allow the parabolic sound reflector to withstand the heat from a gas fire in a fireplace when the parabolic sound reflector is placed within a fireplace between gas fireplace logs and a back wall of the fireplace; the parabolic sound reflector having a parabolic shaped concave surface for reflecting and directing sound waves in a desired direction; the scent dispensing mechanism having a scent dispensing nozzle positioned in the scent dispensing aperture of the heat resistant housing for dispensing a non-volatile scent agent from the scent dispenser to the exterior of the heat resistant housing; the sound generating mechanism including a sound generating chip, an audio amplifier circuit, a volume control circuit including a volume control adjustment knob, an infrared detector for detecting the heat from a fire burning in a fireplace and a speaker assembly mounted on a rotating gimbal and positioned with respect to the sound emitting aperture formed through the heat resistant housing such that the sound generated by the speaker can be directed toward the parabolic concave surface of the parabolic sound reflector by orienting the speaker using the rotating gimbal; the sound generating chip generating a crackling fire sound in response to a fire detected signal from the infrared detector; the scent dispensing mechanism further including a timer responsive to the infrared detector for triggering scent dispensing events; the scent dispensing mechanism operating when the infrared detector outputs a fire detected signal and not operating when the infrared detector does not output a fire detected signal.

BACKGROUND ART

Gas fireplace logs are increasingly being installed in fireplaces as the result of pollution control regulations and the convenience to the user. Although gas fireplace logs burn cleanly, produce little pollution and generate no ashes to remove, they are deficient in certain esthetic qualities because they do not generate the crackling sound or the slight smoke scent normally generated by burning natural logs in a fireplace. Because the sound and smell of burning logs is desirable to many fireplace users, it would be a benefit to have a fireplace accessory for use with a gas log fireplaces that included a crackling sound generating mechanism for simulating the sounds of a log fire and a scent dispensing mechanism for simulating the slight smoke scent of a log fire. Because it would be desirable to have the fireplace operate as naturally as possible, it would be further benefit if the fireplace accessory included an infrared heat sensor in controlling connection with the sound generating mechanism and the scent dispensing mechanism such that when a fire is burning in the fireplace, the sound and scent generating mechanisms are in operation. Because electronics typically will not stand the heat generated within a fireplace and the crackling fire sound would be most realistic when emitted from the fireplace, it would be a further benefit if the fireplace accessory also included a parabolic sound reflector that could be positioned within the fireplace so that the crackling fire sound could be generated outside of the fireplace and then directed toward the parabolic sound reflector positioned within the fireplace which would reflect the crackling fire sound out of the fireplace such that the crackling fire sound would appear to originate from within the fireplace.

GENERAL SUMMARY DISCUSSION OF INVENTION

It is thus an object of the invention to provide a fireplace accessory that includes a heat resistant housing having a hollow interior in connection with the exterior thereof through a scent dispensing aperture and a sound emitting aperture, a sound generating mechanism for generating the crackling sound of a burning fire positioned within the heat resistant housing, a scent dispensing mechanism for dispensing a scent similar to the scent of a burning wood fire positioned within the heat resistant housing, and a parabolic sound reflector constructed of a material with sufficient heat resistance to allow the parabolic sound reflector to withstand the heat from a gas fire in a fireplace when the parabolic sound reflector is placed within a fireplace between gas fireplace logs and a back wall of the fireplace; the parabolic sound reflector having a parabolic shaped concave surface for reflecting and directing sound waves in a desired direction; the scent dispensing mechanism having a scent dispensing nozzle positioned in the scent dispensing aperture of the heat resistant housing for dispensing a non-volatile scent agent from the scent dispenser to the exterior of the heat resistant housing; the sound generating mechanism including a sound generating chip, an audio amplifier circuit, a volume control circuit including a volume control adjustment knob, an infrared detector for detecting the heat from a fire burning in a fireplace and a speaker assembly mounted on a rotating gimbal and positioned with respect to the sound emitting aperture formed through the heat resistant housing such that the sound generated by the speaker can be directed toward the parabolic concave surface of the parabolic sound reflector by orienting the speaker using the rotating gimbal; the sound generating chip generating a crackling fire sound in response to a fire detected signal from the infrared detector; the scent dispensing mechanism further including a timer responsive to the infrared detector for triggering scent dispensing events; the scent dispensing mechanism operating when the infrared detector outputs a fire detected signal and not operating when the infrared detector does not output a fire detected signal.

Accordingly, a fireplace accessory is provided. The fireplace accessory includes a heat resistant housing having a hollow interior in connection with the exterior thereof through a scent dispensing aperture and a sound emitting aperture, a sound generating mechanism for generating the crackling sound of a burning fire positioned within the heat resistant housing, a scent dispensing mechanism for dispensing a scent similar to the scent of a burning wood fire positioned within the heat resistant housing, and a parabolic sound reflector constructed of a material with sufficient heat resistance to allow the parabolic sound reflector to withstand the heat from a gas fire in a fireplace when the parabolic sound reflector is placed within a fireplace between gas fireplace logs and a back wall of the fireplace; the parabolic sound reflector having a parabolic shaped concave surface for reflecting and directing sound waves in a desired direction; the scent dispensing mechanism having a scent dispensing nozzle positioned in the scent dispensing aperture of the heat resistant housing for dispensing a non-volatile scent agent from the scent dispenser to the exterior of the heat resistant housing; the sound generating mechanism including a sound generating chip, an audio amplifier circuit, a volume control circuit including a volume control adjustment knob, an infrared detector for detecting the heat from a fire burning in a fireplace and a speaker assembly mounted on a rotating gimbal and positioned with respect to the sound emitting aperture formed through the heat resistant housing such that the sound generated by the speaker can be directed toward the parabolic concave surface of the parabolic sound reflector by orienting the speaker using the rotating gimbal; the sound generating chip generating a crackling fire sound in response to a fire detected signal from the infrared detector; the scent dispensing mechanism further including a timer responsive to the infrared detector for triggering scent dispensing events; the scent dispensing mechanism operating when the infrared detector outputs a fire detected signal and not operating when the infrared detector does not output a fire detected signal.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
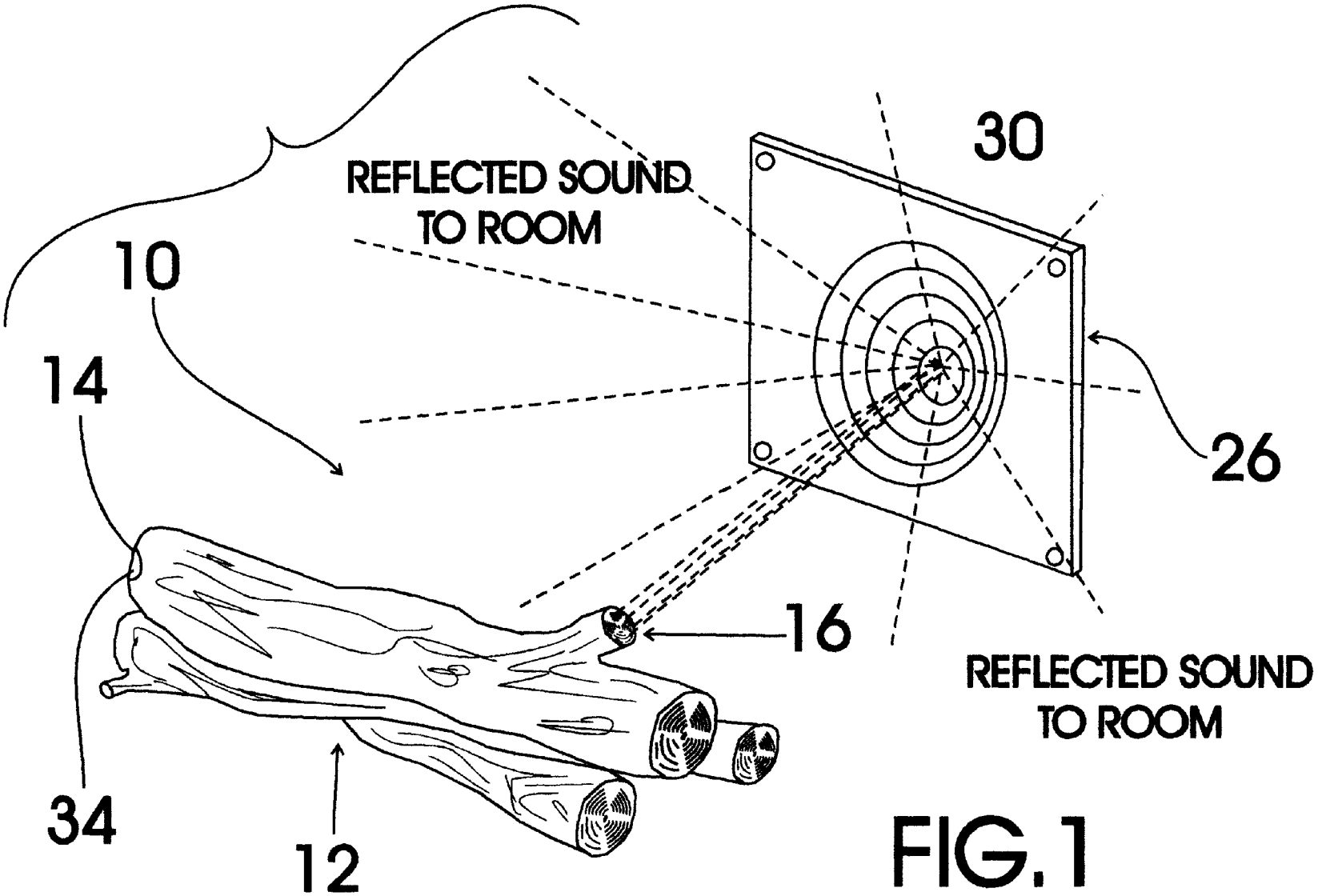
FIG. 1 is a perspective view of an exemplary embodiment of the fireplace accessory of the present invention.
Figure 2:
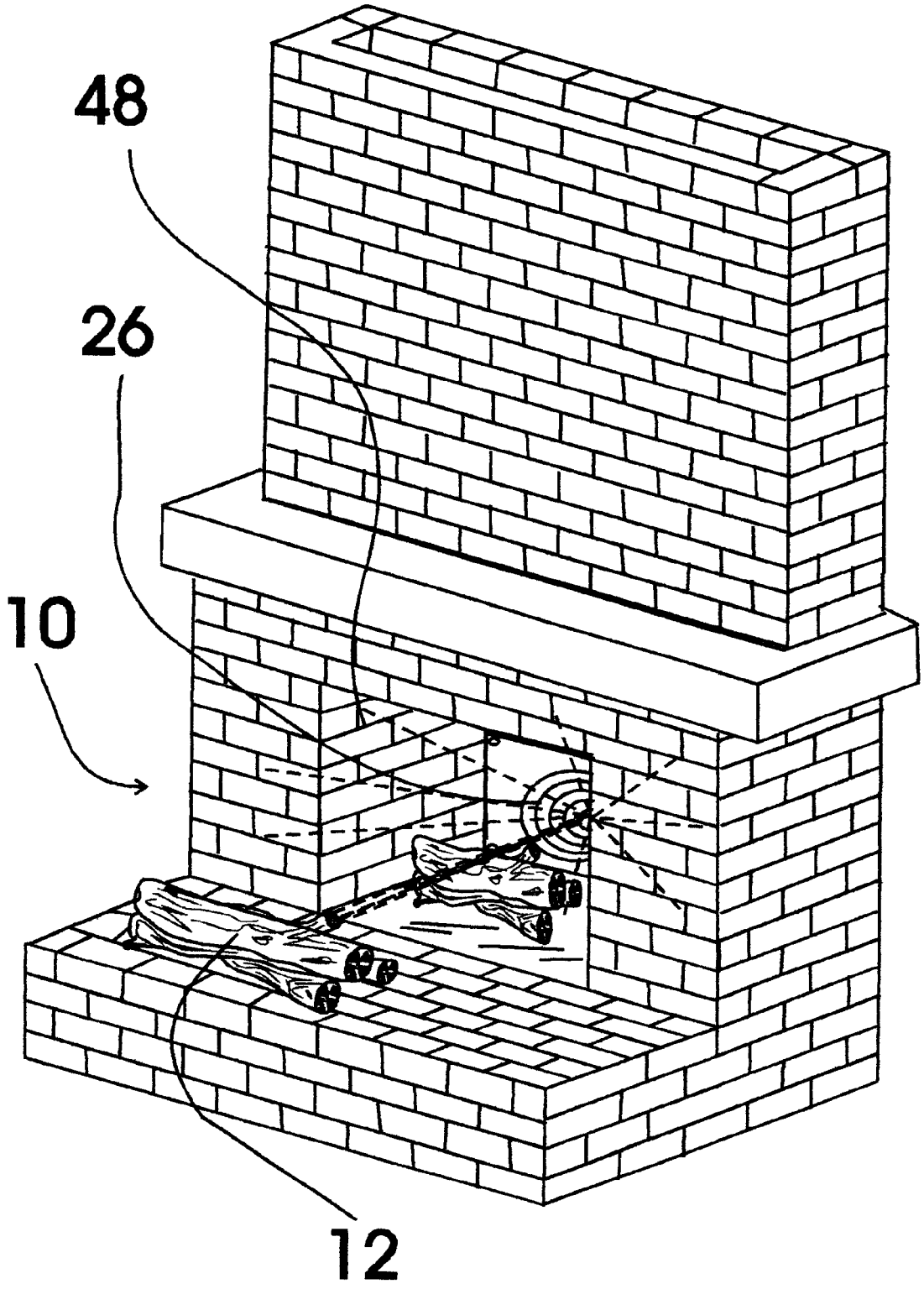
FIG. 2 is a perspective view of the fireplace accessory of FIG. 1 positioned in connection with a representative fireplace.
Figure 3:
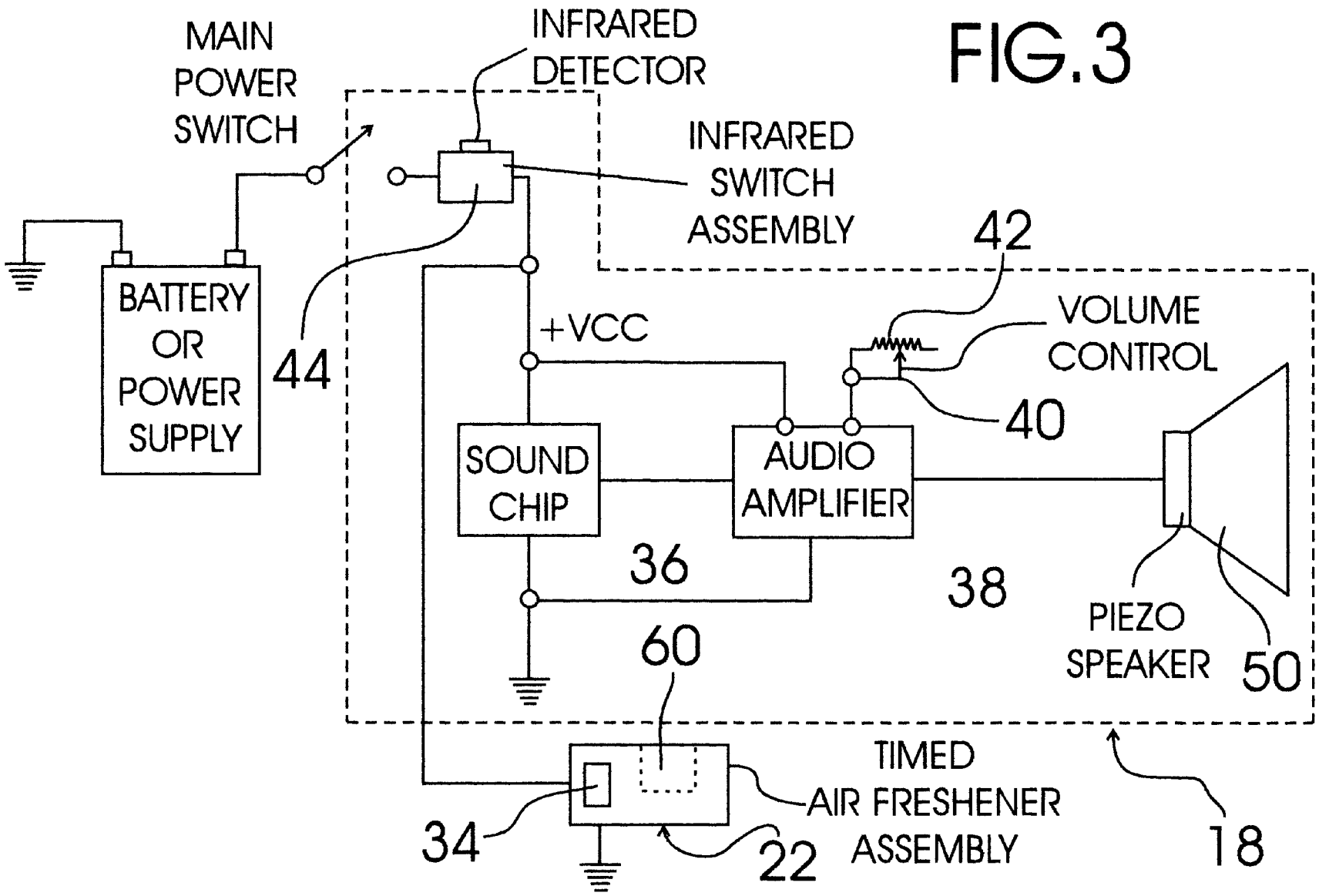
FIG. 3 is a schematic diagram of the sound generating mechanism and the scent dispensing mechanism.
Figure 4:
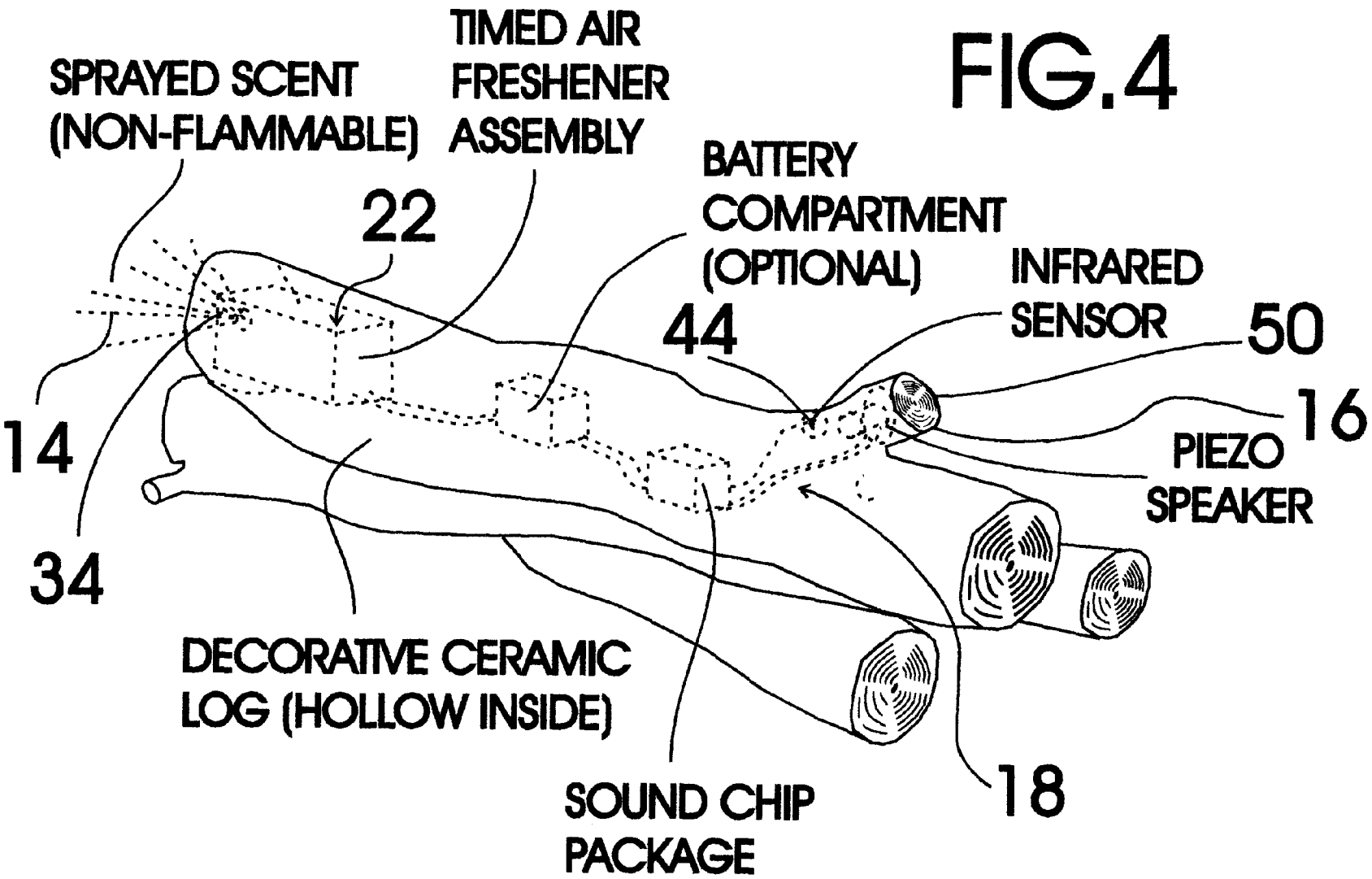
FIG. 4 is a cutaway perspective view showing the sound generating mechanism and the scent dispensing mechanism positioned within the heat resistant housing.
Figure 5:
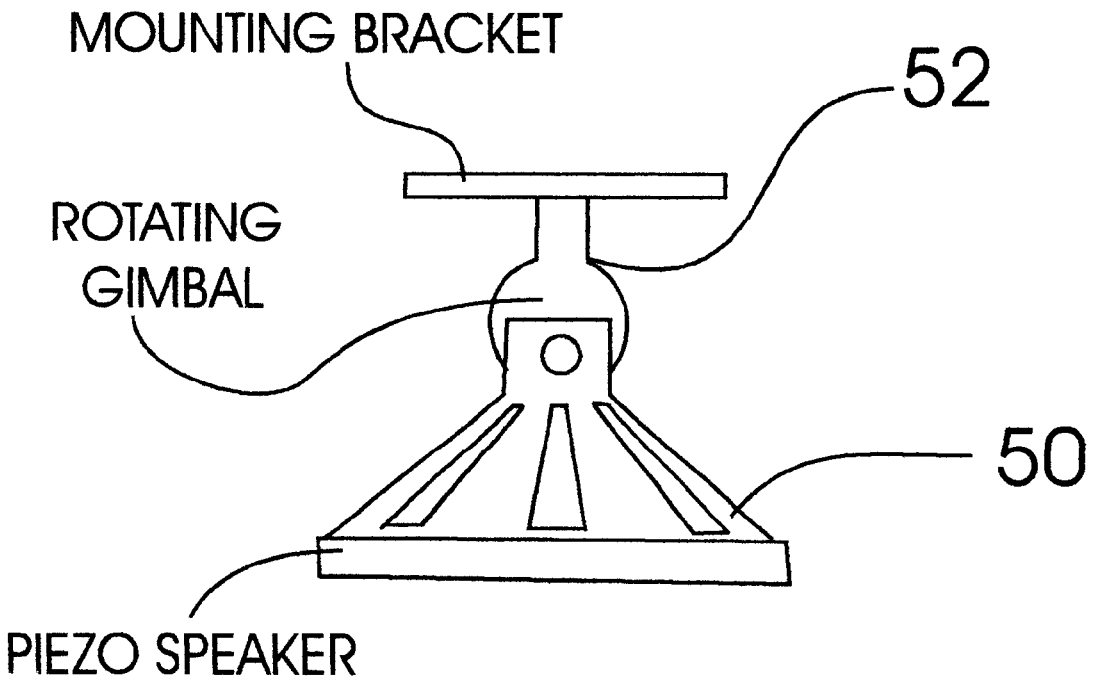
FIG. 5 is a detail plan view showing the speaker mounted to the rotating gimbal.

FIGS. 1–5 show various aspects of an exemplary embodiment of the fireplace accessory of the present invention generally designated 10. Fireplace accessory 10 includes a log-shaped, heat resistant housing, generally designated 12, having a hollow interior in connection with the exterior thereof through a scent dispensing aperture 14 and a sound emitting aperture 16; a sound generating mechanism, generally designated 18, positioned within heat resistant housing 12 for generating the crackling sound of a burning fire; a scent dispensing mechanism, generally designated 22, positioned within heat resistant housing 12 for dispensing a non-volatile smoke scent similar to the scent of a burning wood fire; and a parabolic sound reflector, generally designated 26 constructed of steel with a sufficient heat resistance to allow the parabolic sound reflector 26 to withstand the heat from a gas fire in a fireplace, generally designated 48, when parabolic sound reflector 26 is placed within fireplace 48 between gas fireplace logs and a back wall of fireplace 48. Parabolic sound reflector 26 has a parabolic shaped concave surface 30 for reflecting and directing sound waves in a desired direction.

Scent dispensing mechanism 22 has a scent dispensing nozzle 34 positioned in scent dispensing aperture 14 of heat resistant housing 12 for dispensing a non-volatile scent agent to the exterior of heat resistant housing 12.

Sound generating mechanism 18 includes a sound generating chip 36, an audio amplifier circuit 38, a volume control circuit 40 including a volume control adjustment knob 42, an infrared detector 44 for detecting heat from a fire burning in a fireplace 48 and a speaker assembly 50 mounted on a rotating gimbal 52 and positioned with respect to sound emitting aperture 16 formed through heat resistant housing 12 such that the sound generated by speaker 50 can be directed toward parabolic concave surface 30 of parabolic sound reflector 26 by orienting speaker 50 using rotating gimbal 52.

Sound generating chip 36 generates a signal corresponding to a crackling fire sound in response to a fire detected signal from infrared detector 44. Scent dispensing mechanism 22 includes a timer circuit 60 responsive to infrared detector 44 for triggering scent dispensing events. Scent dispensing mechanism 22 is in operation when infrared detector 44 outputs a fire detected signal and off when infrared detector 44 does not output a fire detected signal.

It can be seen from the preceding description that a fireplace accessory has been provided.

It is noted that the embodiment of the fireplace accessory described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A fireplace accessory comprising:

a heat resistant housing having a hollow interior in connection with an exterior thereof through a scent dispensing aperture and a sound emitting aperture;

a sound generating mechanism positioned within said heat resistant housing for generating a crackling sound of a burning fire;

a scent dispensing mechanism positioned within said heat resistant housing for dispensing a scent similar to a scent of a burning wood fire; and a parabolic sound reflector constructed of a material with sufficient heat resistance to allow said parabolic sound reflector to withstand heat generated by a gas fire in a fireplace when said parabolic sound reflector is placed within the fireplace between gas fireplace logs and a back wall of the fireplace;

said parabolic sound reflector having a parabolic shaped concave surface for reflecting and directing sound waves in a desired direction;

said scent dispensing mechanism having a scent dispensing nozzle positioned in said scent dispensing aperture of said heat resistant housing for dispensing a non-volatile scent agent to said exterior of said heat resistant housing;

said sound generating mechanism including a sound generating chip, an audio amplifier circuit, a volume control circuit including a volume control adjustment knob, an infrared detector for detecting heat from a fire burning in the fireplace and a speaker assembly mounted on a rotating gimbal and positioned with respect to said sound emitting aperture formed through said heat resistant housing such that the sound generated by said speaker can be directed toward said parabolic concave surface of said parabolic sound reflector by orienting said speaker using said rotating gimbal;

said sound generating chip generating a crackling fire sound in response to a fire detected signal from said infrared detector;

said scent dispensing mechanism further including a timer responsive to said infrared detector for triggering scent dispensing events;

said scent dispensing mechanism being in operation while said infrared detector outputs a fire detected signal and off while said infrared detector is not outputting a fire detected signal.

* * * * *